US006647938B2

(12) United States Patent
Gaessler et al.

(10) Patent No.: US 6,647,938 B2
(45) Date of Patent: Nov. 18, 2003

(54) SUPPLY PRESSURE PUMP WITH SEPARATE DRIVE ON AN INTERNAL COMBUSTION ENGINE

(75) Inventors: Hermann Gaessler, Vaihingen (DE); Udo Diehl, Stuttgart (DE); Karsten Mischker, Leonberg (DE); Rainer Walter, Pleidelsheim (DE); Bernd Rosenau, Tamm (DE); Juergen Schiemann, Markgroeningen (DE); Christian Grosse, Kornwestheim (DE); Georg Mallebrein, Korntal-Muenchingen (DE); Volker Beuche, Stuttgart (DE); Stefan Reimer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/146,285

(22) Filed: May 15, 2002

(65) Prior Publication Data

US 2003/0005904 A1 Jan. 9, 2003

(30) Foreign Application Priority Data

May 17, 2001 (DE) ..... 101 24 108

(51) Int. Cl.[7] ..... F02N 17/00

(52) U.S. Cl. ..... 123/179.17; 123/90.12; 123/446

(58) Field of Search ..... 123/179.17, 196 R, 123/446, 90.12, 90.33

(56) References Cited

U.S. PATENT DOCUMENTS 6,058,912 A * 5/2000 Rembold et al. ..... 123/516
6,065,436 A * 5/2000 Koga et al. ..... 123/179.17

* cited by examiner

*Primary Examiner*—Tony M. Argenbright
*Assistant Examiner*—Katrina B. Harris
(74) *Attorney, Agent, or Firm*—Michael J. Striker

(57) ABSTRACT

The invention relates to a device of the build-up of pressure in supply systems (6, 11, 20, and 23) to components (19, 36) on internal combustion engines (2). The invention includes directly couples lubricant systems and pressure-generating systems (3, 8), an electric fuel pump (34), as well as a control apparatus for determining lubricant pressures. A supply module (12, 34) is provided with an independent drive (16) and supplies lubricant in the lubricant oil circuit (24) or to selected lubricating position, or fuel into a fuel supply (36). The supply module (12, 34) can optionally include a pressure converter (30).

13 Claims, 4 Drawing Sheets

SUPPLY PRESSURE PUMP WITH SEPARATE DRIVE ON AN INTERNAL COMBUSTION ENGINE

BACKGROUND OF THE INVENTION

For starting an internal combustion engine, which has am electro-hydraulic valve gear, a pressure supply system for the valve gear is required to form the pressure. The faster the pressure build-up in the supply system for the electro-hydraulic valve gear can take place, the shorter the start time of an internal combustion engine, which aids in the careful treatment of the Kfz-battery in low temperature and limits wear on the battery during the cold start phase.

Increasingly, motor vehicles with a variable or fully variable valve control (VVC) are being developed. The goal of these inventions is an increase of the engine efficiency, for example, by means of the throttle and optimizing the gas-changing to the cylinders of the internal combustion engine. One direction of development is provided in the electro-hydraulic valve control (EHVC). With the electro-hydraulic valve control, the force introduction in the gas-change valve takes place in a hydraulic manner, the control of the force flow being electric, for example, through the use of magnetic valves. For production of the operating pressure in the supply system of the electro-hydraulic valve gear, a supply pressure is produced on its primary pump, which is made ready by means of the lubricating oil pump of the internal combustion engine.

In low temperatures, which can cause a reduced durability of the vehicle battery, the starter that starts the internal combustion engine must turn-over the battery longer, in order to produce the required supply pressure to the primary pump of the electro-hydraulic valve gear alone with the lubricating oil pump of the internal combustion engine. During the starting-phase of an internal combustion engine, all of the bearings of the internal combustion engine are no provided with a friction-reducing amount of lubricating oil, so that during the starting-phase, high wear in the contact areas of the components moveable relative to one another can occur. Therefore, a shortening of the starting-phase of an internal combustion engine is necessary.

SUMMARY OF THE INVENTION

The primary advantage of the solution of the present invention lies in a drastic shortening of the starting-time of an internal combustion engine, whether it is a compression internal combustion engine or an internal combustion engine with vacuum pipe injection or direct fuel injection. With the present invention, the time span in which the internal combustion engine is exposed to the highest wear is drastically reduced. This positively affects the starting-phase of the internal combustion engine, in particular, when the engine is started in the colder seasons with reduced voltage levels in the vehicle battery. The shorter the starting-phase of an internal combustion engine, the smaller the load is on the starter and, therewith, the load on the vehicle battery.

With the proposed solution of the present invention, a started can be completely avoided, when, with adequate dimensioning of the starting pressure pump module with an electric starting pressure pump, a direct start of the internal combustion engine with the electro-hydraulic valve control (EHVC) can be bought about without interposition of a starter. This is achievable with internal combustion engines with direct fuel injection, in that a control apparatus arranged in the direct-injection engine and a start function there, respectively, can supply each, nearest possible cylinder of the internal combustion engine with the mixture and ignite the same for starting.

When the required supply pressure for operation of the electro-hydraulic valve gear is produced by means of a supply unit with a separate drive, the pressure buildup in the electro-hydraulic valve gear system is independent from the rotation (starter movement) of the internal combustion engine. Thereby, a faster overall oiling of the engine is produced by means of supply pressure production, which, particularly, during the cold seasons and with viscous lubricating agents, is very desirable, in order to keep the wear that occurs during the starting-phase to a minimum. In particular, with low temperatures, based on the qualities of the lubricating material is must be accurately determined that the critical area, that is, the bearings of moveable components such as the connecting rod-bearing/crank-bearing, etc., are supplied with a sufficient supply of lubricating material, and the lubricating material already supplied during the starting-phase is continuously circulated. An advantageous variation of the invention solution is that diesel systems or internal combustion engines with direct fuel-injection systems with a common rail, which are provided with an electric fuel pump, also can be used for pressure production in a supply system of the electro-hydraulic valve gear. The electric fuel pump, therefore, can be engaged with several functions, so that through interposition of a pressure converter, various pressure levels for various systems on the internal combustion engine can be set and can be supplied permanently with the corresponding operating pressure.

DETAILED DESCRIPTION OF THE PREFERRED EMBODIMENTS

Figure 1:
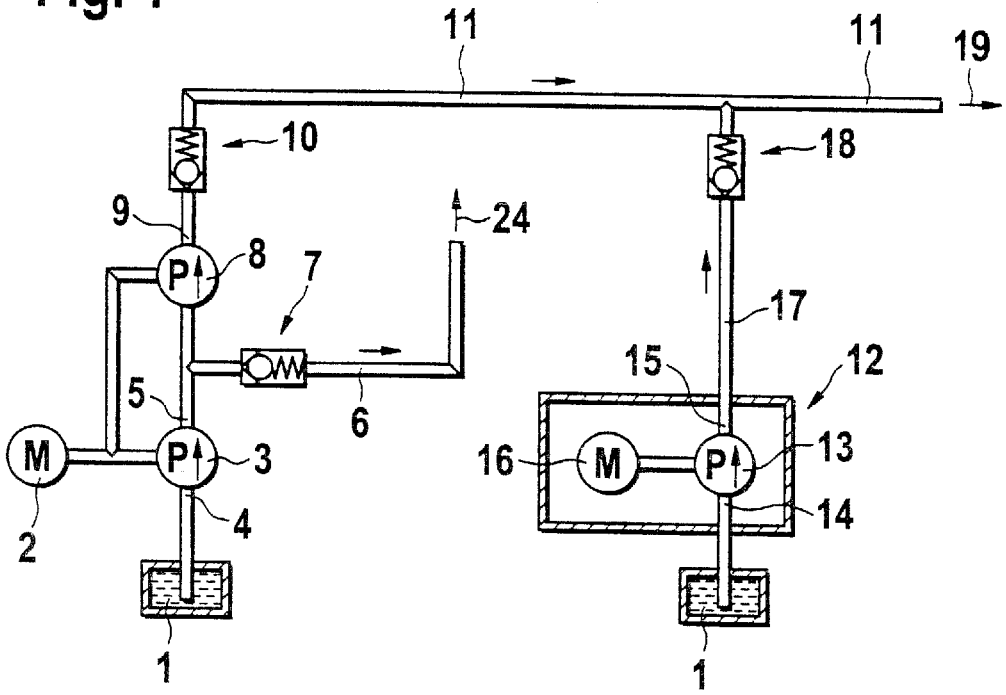
FIG. 1 shows an embodiment of the present invention with a starting-pressure pump module, which is connected parallel to the oil pump of the internal combustion engine.

FIG. 1 provides a first embodiment of the invention, with a starting-pressure pump module, which is operated parallel with the lubricant pump directly coupled with the internal combustion engine.

According to the illustration in FIG. 1, an internal combustion engine 2 includes a lubricant pump 3 (supply pump) directly coupled to the engine 2, as well as a main pump 8 (pressure supply electro-hydraulic valve system, or EHVS). The lubricating oil pump 3 is connected on its suction side 4 with a lubricating agent supply (oil sump). The lubricating oil pump 3 used as a supply pump is connected with a main pump 8 via a line section, the main pump 8, likewise, being directly driven by the internal combustion engine 2. From the pressure side 9 of the main pump 8, a supply line 11 connects to an electro-hydraulic valve control system 19 (not represented here). In the supply line 11, a check valve 10 is provided.

In a line section between the lubricating oil pump 3 serving as a supply pump and the main pump 8, a supply line 6 to the lubricating oil circuit 24 branches off. A check valve 7 is likewise provided in the supply line 6. Parallel to the supply unit 3 and 8 for lubricant and pressure supply directly driven by the internal combustion engine 2, a starting pressure pump module 12 is connected. The starting pressure module 12 contains a starting pressure pump 6, which is driven preferably with an electric drive 16 that is independent from the internal combustion engine 2. The starting pressure pump 13 is connected at its suction side 14, likewise, with the lubricating agent supply (oil sump), not schematically represented here; on its pressure side 15, a bypass line 17 is connected, by means of which the pressurized lubricant supply can be supplied to an electro-hydraulic valve system 19 (EHVS) via a check valve 18 in the bypass line 18 and into the supply line 11.

In a starting situation, the main oil flow is completely bridges via the lubricant pump 3, driven by the crank shaft of the internal combustion engine 2, and the main pump 8 by the electrically driven pump 13 of the starting pressure pump module 12, so that the electro-hydraulic valve control system 19 can be supplied with lubricant by means of the bypass line 17, which opens into the supply line 11. The starter and the internal combustion engine 2, as well as the lubricant unit 3 (or pressure supply unit 8) directly coupled to the engine, remain stationary. Upon supplying only via the starting pressure pump 13 of the starting pressure pump module 12, the check valve 10 of the supply line 11 to the electro-hydraulic system 19 prevents a flow of the pressurized lubricating means via the still-standing supply unit 8, 3 back into the lubricating agent supply 1. If a sufficiently high pressure is built up in the supply line 11 to the electro-hydraulic valve control 19, a control of the gas change valve can be provided by means of a control apparatus (not shown here), and the starter is operated, so that the internal combustion engine, particularly under cold starting conditions, can be started with the least possible wear and abrasion. With a direction fuel-injection system and a corresponding sensor, the starting can be directly provided so that a starter can be avoided. According to this starting variation, starter provided on the internal combustion engine 2 first is controlled after the first pressure production by means of the starting pressure pump module 12.

Another starting situation is provided by an immediately following starter of the internal combustion engine 2. In the case of this starting process, the starter follows immediately by the rotation of the internal combustion engine. By means of the lubricating oil pump 3 serving as a supply pump and the main pump 3, additional lubricant is supplied in the supply line 11 to the electro-hydraulic valve system 19. Subject to the check valve 10 in the supply line 11 and 18 in the bypass line 17, a gliding passage from the pressure generator through the starting pressure pump module 12 via the starting pressure pump 13 to the primary supply path via the lubricating oil pump 3 (directly driven by the internal combustion engine 2) and the main pump 8 can be achieved. With increasing rotational speed after a successful starting of the engine, the pressure in the electro-hydraulic valve control 19 via both pumps 3, 8 directly driven by the engine 2 is higher than the pressure that is produced from the starting pressure pump 13 in the starting pressure module 12. The check valve 18 in the bypass line 17 prevents a flowing back of the pressurized fluid by means of the starting pressure pump 13 to the lubricant supply 1, the starting pressure pump 13 producing less pressure compared to the lubricant supply unit 3, 8.

In both starting situations, the starting pressure pump 13 of the starting pressure pump module 12 is actuated after successfully starting the internal combustion engine, or upon exceeding a determined pressure value in the supply line 11 to the electro-hydraulic valve control 19.

Figure 2:
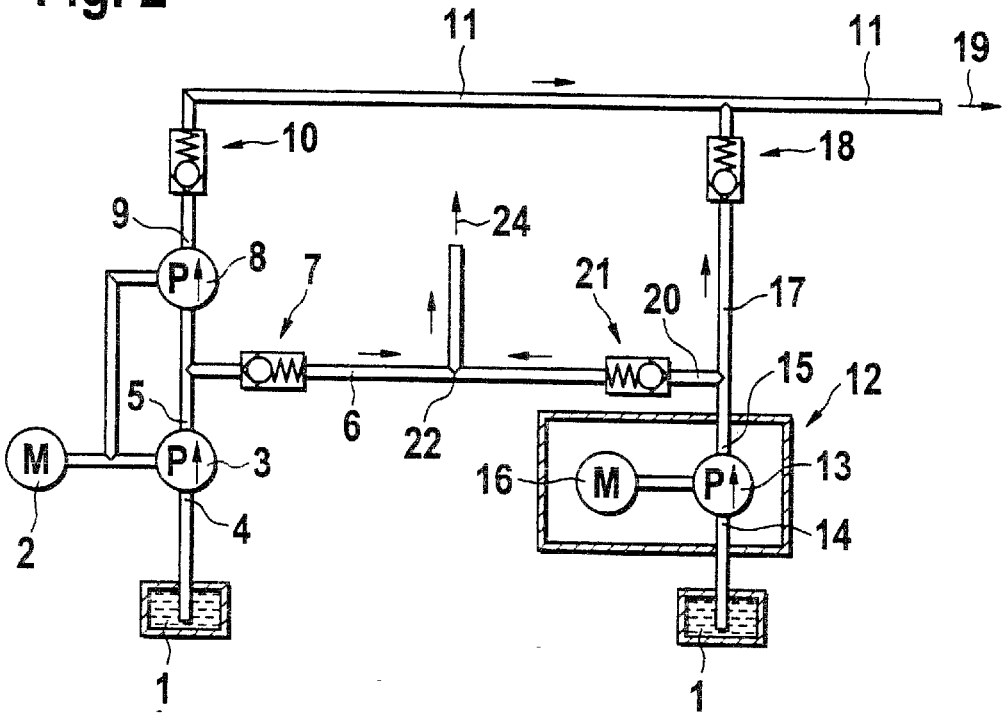
FIG. 2 shows an embodiment of the present invention with an added branch of the starting-pressure pump module for supplying the lubricating oil circuit and for supplying the electro-hydraulic valve control.

FIG. 2 shows an embodiment with the branch connected to the starting pressure pump module, for supplying a lubricating oil circuit as well as for supplying the EHVS circuit.

According to this further embodiment of the invention, a first supply branch 20 is connected in the bypass line 17, which is disposed on the pressure side of the starting pressure pump module 12. In the first supply line 20, a further check valve 21 is provided. The first supply branch 20 extends to a junction point 22, at which the supply branch 6 to the lubricating oil circuit 24 opens. With this embodiment of the present invention, not only a pressure production in the supply line 11 to the electro-hydraulic valve control 19 is achieved, but also a circulation of lubricant in the total lubricating oil circuit 24 of the internal combustion engine 2 is realized. This provides the advantage that the internal combustion engine 2 is lubricated thoroughly must more quickly, and most importantly, with regard to the cold start conditions, a reduction of the wear and abrasion within the internal combustion engine 2 occurs.

Figure 3:
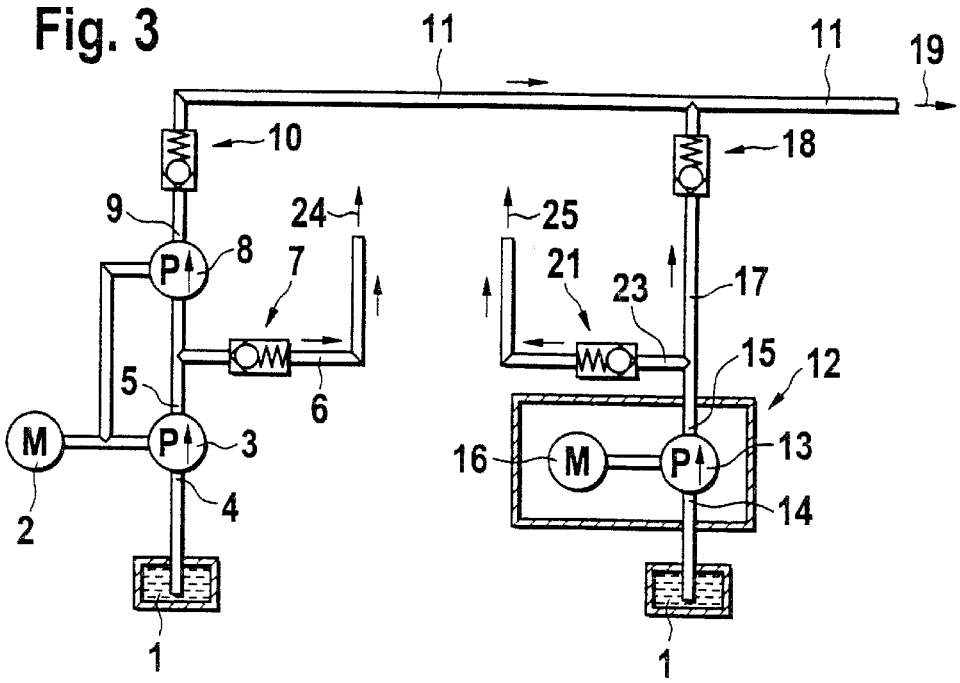
FIG. 3 shows an embodiment with the branch of the starting-pressure pump for supplying lubrication to selected lubricating positions.

FIG. 3 shows an embodiment with a starting pressure pump module having a branch for supplying lubricant to selected lubricating points.

In this embodiment of FIG. 3, the total lubricating agent circuit 24 of the internal combustion engine 2 is supplied via the supply branch 6 of the line section between the lubricating oil pump 3 (the supply pump) and the main pump 8. A second supply branch 23 with a check valve 21 arranged therein, which branches off from the starting pressure pump module 12 on the bypass line 17, supplies selected lubricating positions 25 of the internal combustion engine with lubricant. The selected lubricant positions 25 of an internal combustion engine 2 include, in particular, crank shaft bearings and other highly used, mechanical components. The earlier a lubricating agent supply is available for supplying, the smaller the required starting burden is upon starting the internal combustion engine.

Figure 4:
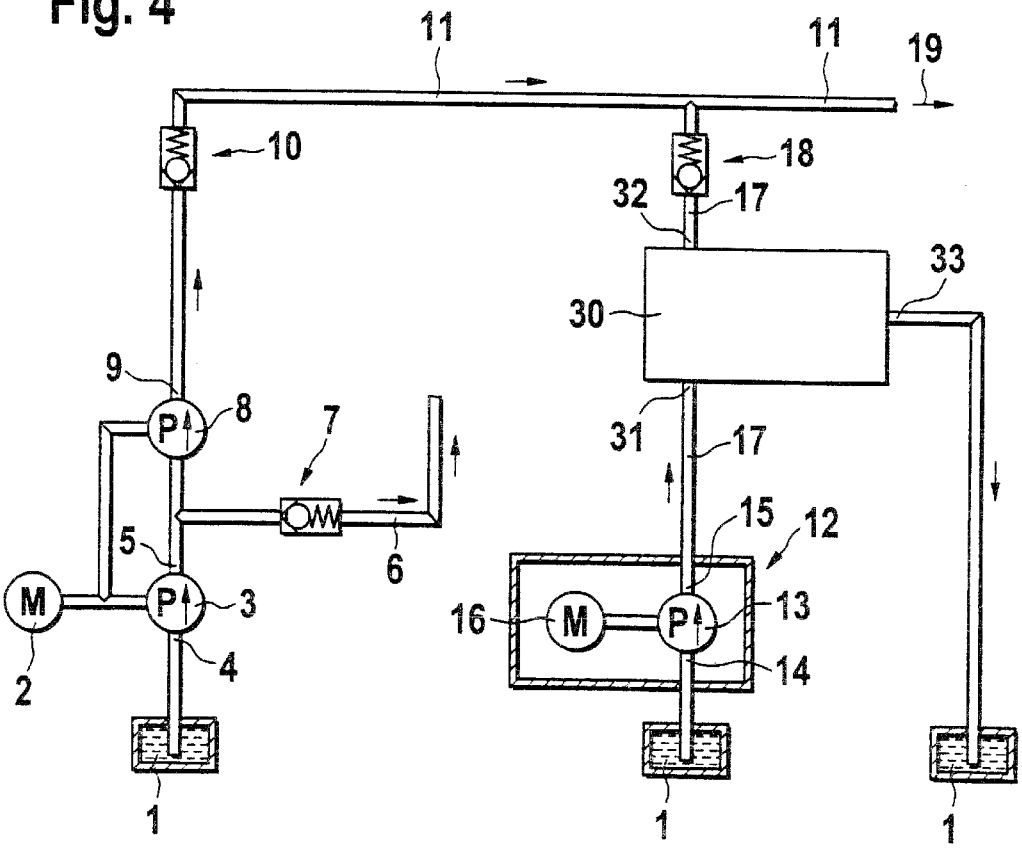
FIG. 4 shows an embodiment with the pressure converter.

FIG. 4 shows a further embodiment of the present invention with the previously described starting pressure pump, which also includes a pressure converter.

Analogous to FIGS. 1, 2, and 3, a supply pump, operating as a lubricating oil pump 3 as well as a main pump 8 are directly coupled to the internal combustion engine 2. The lubricating oil pump 3 is connected on the suction side with a lubricant supply 1; between the supply pump 3 and the main pump 3 of the lubricant and pressure supply circuit of the internal combustion engine, a supply branch 6 is provided, in which a check valve 7 is disposed. A further check valve 10 is positioned in the supply line 11 (as in FIGS. 1 through 3) to an electro-hydraulic valve control 19 (not shown here), which is supplied with pressure oil (working fluid) by means of the supply line 11. The electro-hydraulic valve control provided on the internal combustion engine can be impinged with a pressurized fluid for moving the gas change valve.

In the bypass line 17, which is connected on the pressure side 15 of the starting pressure pump 13 of the starting pressure pump module 12, can be provided optionally with a pressure converter, for example an oscillating pressure converter 30. This is connected at the inlet side (reference numeral 31) to the starting pressure pump 13 via the bypass 17 and at the outlet side (32) with the section of the bypass line 17 in which the check valve is disposed. On the oscillating pressure converter 30, a reflux line 33 is connected over which lubricant can be returned into the lubricant reservoir 1 (oil sump). The connection of a pressure converter 30 behind a starting pressure pump module 12 whose starting pressure pump 13 is driven by means of a separate drive, such as an electric drive 16, has the advantage that the electrically driven starting pressure pump 13 need not deliver the total pressure required in the supply line 11 to the electro-hydraulic valve control 19, rather that the total pressure can be build up by means of the interposition of an oscillating pressure converter 30.

Figure 5:
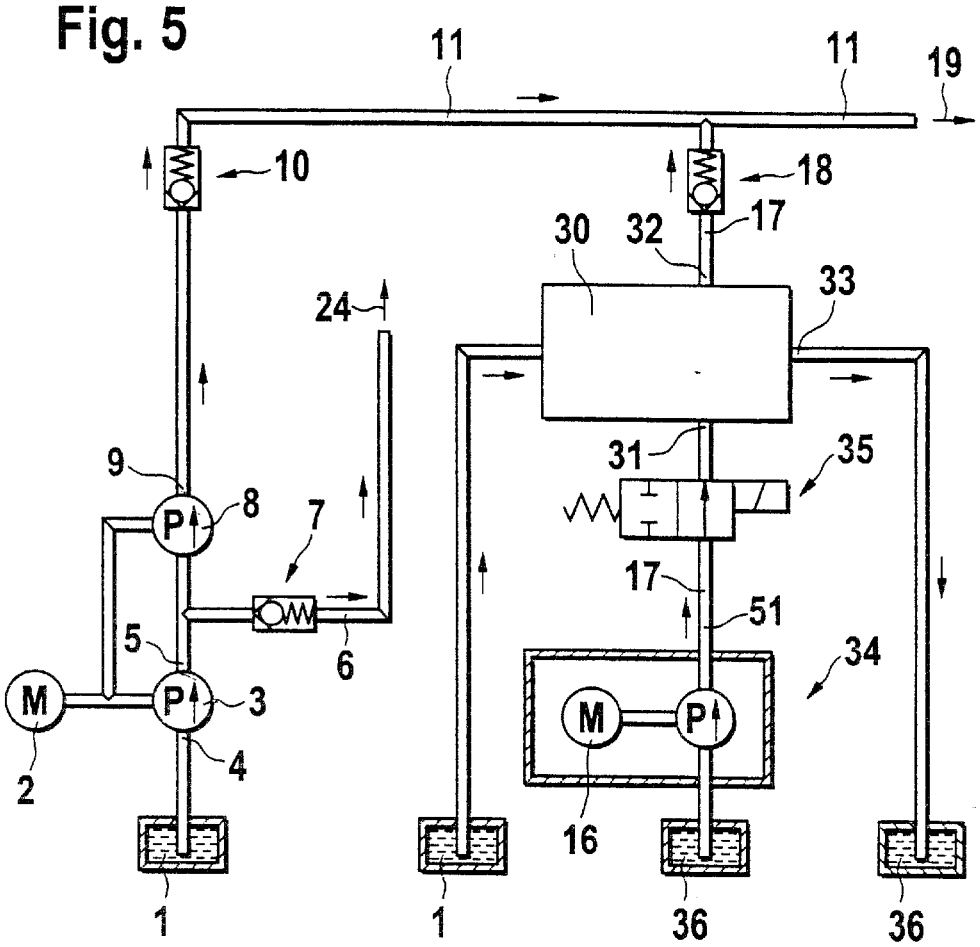
FIG. 5 shows an embodiment with pressure production by means of an electric fuel pump.

The embodiment shown in FIG. 5 relates to pressure production by means of an electric fuel pump.

The embodiment of FIG. 5 corresponds to the direct coupling of the lubricating oil pump 3 (supply pump) and the main pump 8 with the internal combustion engine 2 noted above with reference to the embodiments of FIGS. 1 through 4. According to this embodiment, a lubricant circuit 24 is supplied via a supply branch 6, in which a check valve 7 is positioned, whereby the supply branch 6 branches off in the line section between the lubricant pump 3 and the main pump 8 of the pressure oil supply path.

In contrast to the embodiments represented in FIGS. 1 through 4, an electric fuel pump is provided as an additional starting pressure source in the embodiment of FIG. 5. The electric fuel pump, likewise, is driven by means of a separate drive from the internal combustion engine 2 that is independently drivable. A bypass line 17 extends from the electric fuel pump 34 to a pilot valve 35, which is lined up with an oscillating pressure converter 30 in the bypass line. In front of the pilot valve 35, a supply line to the fuel supply 35 of the internal combustion engine branches off. On the oscillating pressure converter 30, the inlet side of the fuel is designated with reference numeral 31 and the inlet side of the lubricant/pressure oil is designated with reference numeral 49, while the outlet side of the pressure oil is designated with reference numeral 32. Via the reverse line 33, the oscillating pressure converter 30 is connected with a fuel tank 36.

By means of the embodiment shown in FIG. 5, an electric fuel pump 34 is advantageously used for creating a pressure build-up for an electro-hydraulic vale control 19 on an internal combustion engine in a fuel supply system. The interposition of an oscillating pressure converter 30 (as in FIG. 6) enables the pressure produced at the outlet side on the electric fuel pump 34 to be increased many times until the required pressure level in the line 11 to the electro-hydraulic valve control 19 is reached. The check valves 18,10, or 7 are analogous to the forms in the supply branch 6 of the supply line 11, or in the bypass line 17 at the identical locations, described with reference to the embodiments of FIGS. 1 through 4.

Figure 6:
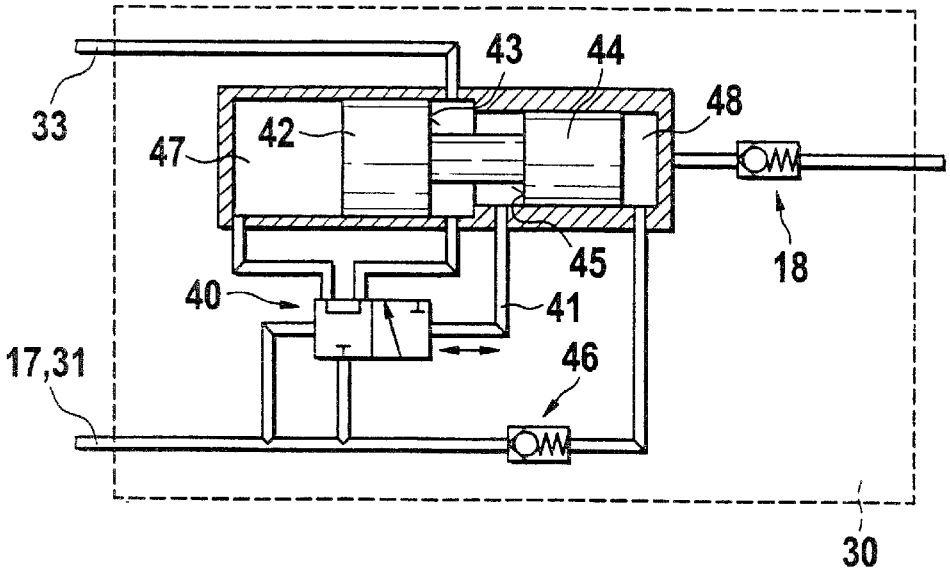
FIG. 6 shows a schematic representation of a hydraulic pressure converter.

The illustration according to FIG. 6 is a schematic representation of a hydraulic pressure converter.

The hydraulic pressure converter 30 includes in between a two-part piston arrangement, which is oscillatingly moveable in a two-part chamber. The oscillating piston part essentially comprises a first piston part 42 with a piston surface 43, as well as a second piston part 44 with a piston surface 45 connected to the first piston part 42. The piston comprising the first piston part 42 and the second piston part 44 oscillates in a chamber surrounding these parts, whereby the chamber is connected at one side with a return or reverse line 33, which permits a flow back of over-flowing fluid into a lubricant supply 1 (oil sump); on the other side, a high pressure chamber 48 within the housing of the oscillating pressure converter 30 is connected with the bypass line 17, in which the starting pressure pump module 12, or the electric fuel pump 34, produces a determined supply pressure level. The oscillating pressure converter according to FIG. 6 is useable in connection with a pressure oil-supplying starting pressure pump module 12. A low-pressure chamber 47 is located on the end of the piston chamber lying opposite to the high-pressure chamber 48. A bi-stable pilot valve 40 is associated with the oscillating pressure converter 30, which is switched between two switching states according to positions of the piston parts 42, 44 by means of a pilot-control line 41. In the position of the piston arrangement 42, 44 shown in FIG. 6, the pilot-control line 41 is released, and thus, the bi-stable pilot valve 40 is released. In this state, the pressure chamber 47 is connected to the return line 33. The existing in-feed pressure acting on the second piston part 44 via the line 17, 31 with integrated check valve brings the piston arrangement 44, 42 in the direction of the low-pressure chamber 47. When the piston surface of the second piston part 44 releases the entrance to the pilot-control line 41 and the in-feed pressure abuts, that is, the piston arrangement 42, 44 has reached is left end position, the bi-stable pilot valve 40 changes its position and a new working cycle is initiated. The piston arrangement 42, 44 is then shifted to the right. The fluid in the high-pressure chamber 48 is pressurized under high pressured against the operation of the check valve 18 in the high-pressure outlet and, for example, can flow to the supply line 11 to the electro-hydraulic valve control 19.

In association with the embodiment of FIG. 6 of an oscillating pressure converter 30 with a bi-stable pilot valve 40, the piston movement of the first piston part 42 and the second piston part 44 can also take place by means of an actively control switch valve (not illustrated here).

Figure 7:
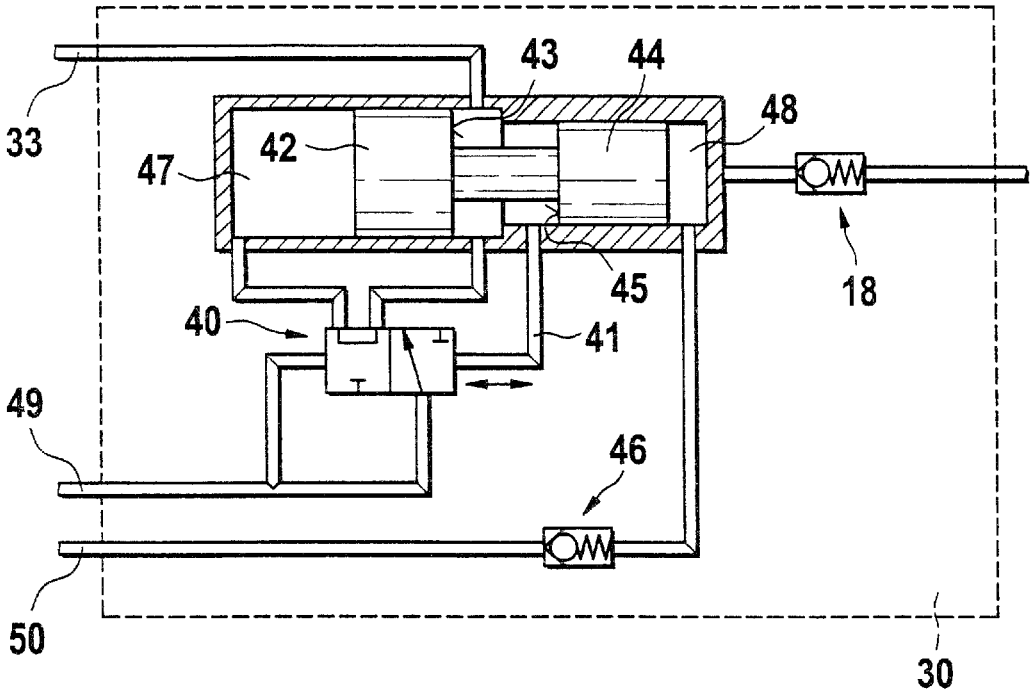
FIG. 7 shows the schematic illustration of a hydraulic pressure converter, which is acted upon by two different mediums (fuel or lubricating- or pressure-oil).

FIG. 7 is a schematic representation of a hydraulic pressure converter, which is impinged with two different media, for example fuel and lubricating oil or pressure oil. In contrast to the oscillating pressure converter 30 of FIG. 6, the pressure converter of FIG. 7 is either impinged either with the first medium or with the second medium via a fuel supply 49 as well as a pressure oil supply 50. Instead of a bi-stabile pilot valve 40, the piston movement of the first piston part 42 and the second piston part 44 can also take place by means of an actively controlled switch valve (not shown here), analogous to the embodiment shown in FIG. 6 of an oscillating pressure converter 30 that can be impinged with a medium.

It will be understood that each of the elements described above, or two or more together, may also find a useful application in other types of constructions differing from the types described above.

While the invention has been illustrated and described herein as a supply pressure pump with a separate drive on an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Device for pressure build-up in supply systems (6, 11, 20, 23) to structural components (19, 36) on an internal combustion engine (2), said components including lubricant supply units pressure-generating units (3, 8) directly coupled to said internal combustion engine, an electric fuel pump (34), and a control apparatus for determination of oil pressure, characterized in that, a supply module (12, 34) is provided with a drive (16) that is independent from the internal combustion engine (2), wherein said supply module (12, 34) supplies lubricant to lubrication positions (24, 25) and/or a valve control (19) of the internal combustion engine (2), or wherein said supply module (12, 34) feeds fuel into a fuel supply (36) of the internal combustion engine.

2. Device as defined in claim 1, wherein the supply module (12) is connected to a supply line to the valve control (19) by means of a bypass line (17).

3. Device as defined in claim 2, wherein check valves (10, 18) are provided in flows of lubricant in the supply line (11) and in the bypass line (17), wherein said check valves (10, 18) prevent low pressure levels in said supply line (11) and said bypass line (17).

4. Device as defined in claim 1, wherein the valve control (19) is an electro-hydraulic valve control of gas change valves on a separately ignited or air compression internal combustion engine.

5. Device as defined in claim 1, wherein said supply module includes supply branches (20, 23), wherein said supply branches (20, 23) assure a supply of lubricant in a lubricant circuit (24) or a supply lubricant to selected lubrication points (25).

6. Device as defined in claim 1, wherein a check valve (21) is provided in each of said supply branches (20, 23).

7. Device as defined in claim 1, wherein said supply module (12) includes a starting pressure pump (13) having a separate drive (16), wherein said separate drive is an electric drive.

8. Device as defined in claim 1, wherein an electric fuel pump (34) of the internal combustion engine is used as the supply module.

9. Device as defined in claim 8, wherein the electric fuel pump (34) includes a pilot valve (35), wherein a supply (36) for supplying fuel to the internal combustion engine branches off in a position in front of said pilot valve (35).

10. Device as defined in claim 1, wherein the supply module (12, 34) further includes a pressure converter (30) positioned in the bypass line (17) to the supply line (11).

11. Device as defined in claim 10, wherein the pressure converter (30) is an oscillating pressure converter with a bi-stabile pilot valve (40).

12. Device as defined in claim 10, wherein the pressure converter (30) is associated with an actively controlled switch valve.

13. Device as defined in claim 1, wherein said supply module is a starting pressure pump module (12).

* * * * *